United States Patent [19]

Miyauchi et al.

[11] Patent Number: 4,490,243

[45] Date of Patent: Dec. 25, 1984

[54] PROCESS FOR THERMAL CRACKING OF HEAVY PETROLEUM OILS

[75] Inventors: Terukatsu Miyauchi, Yokohama; Yoneichi Ikeda, Kamakura; Tatsuji Kikuchi, Tokyo, all of Japan

[73] Assignee: Terukatsu Miyauchi, Yokohama, Japan

[21] Appl. No.: 504,385

[22] Filed: Jun. 15, 1983

Related U.S. Application Data

[63] Continuation of Ser. No. 279,762, Jul. 2, 1981, abandoned.

[30] Foreign Application Priority Data

Jul. 9, 1980 [JP] Japan ..... 55-92664

[51] Int. Cl.[3] ..... C10G 9/32; C10G 25/09

[52] U.S. Cl. ..... 208/127; 208/91

[58] Field of Search ..... 208/127, 118, 91, 52 CT

[56] References Cited

U.S. PATENT DOCUMENTS

| | | | |
|---|---|---|---|
| 2,462,891 | 3/1949 | Woll | 208/91 X |
| 2,880,514 | 4/1954 | Griffin, Jr. | 208/127 |
| 3,193,480 | 7/1965 | Payne | 208/127 |
| 3,228,872 | 1/1966 | Metrailer | 208/118 |
| 3,527,694 | 9/1970 | Luckenback | 208/118 |
| 3,853,744 | 12/1974 | Lann | 208/127 |
| 4,088,567 | 5/1978 | White | 208/113 |
| 4,243,514 | 1/1981 | Bartholic | 208/91 |
| 4,263,128 | 4/1981 | Bartholic | 208/127 |
| 4,299,687 | 11/1981 | Myers et al. | 208/120 |
| 4,325,809 | 4/1982 | Bartholic | 208/52 CT X |
| 4,427,539 | 1/1984 | Busch et al. | 208/127 |

FOREIGN PATENT DOCUMENTS

| | | | |
|---|---|---|---|
| 653355 | 12/1962 | Canada | 208/127 |

*Primary Examiner*—Delbert E. Gantz
*Assistant Examiner*—Glenn A. Caldarola
*Attorney, Agent, or Firm*—Oblon, Fisher, Spivak, McClelland & Maier

[57] ABSTRACT

In a process for thermal cracking of heavy oils in which a heavy petroleum oil is caused to contact a heated fluidized bed of solid particles in the presence of steam thereby to obtain principally light petroelum oils, the solid particles are stable at the temperature of the thermal cracking and are of substantially spherical shape of porous nature of a pore volume of 0.10 to 1.0 $cm^3/g$, a specific surface area of 50 to 1,500 $m^2/g$, and a weight-mean diameter of 0.025 to 0.25 mm.

6 Claims, 2 Drawing Figures

PROCESS FOR THERMAL CRACKING OF HEAVY PETROLEUM OILS

This is a continuation of application Ser. No. 279,762 filed July 2, 1981 now abandoned.

BACKGROUND OF THE INVENTION

1. Field of the art

This invention relates generally to thermal cracking of heavy hydrocarbons and more particularly to a process for thermally cracking heavy hydrocarbons (hereinafter referred to as "heavy petroleum oils") by causing the heavy petroleum oils to contact particles fluidized by principally steam thereby to obtain principally light hydrocarbons (hereinafter referred to as "light petroleum oils") which are in liquid state at room temperature.

2. Prior art

Among the techniques heretofore known of thermally cracking heavy petroleum oils by means of fluidized beds, there are the fluid coking process, and cracking process, and others. In these processes coke formed by thermal cracking, river sand, and other particles are used as fluidized particles. In all cases, there are almost no fine holes or pores in these particles, that is, they are so-called non-porous material, and relatively coarse particles of weight-mean diameters of 0.3 mm or more are being used.

In the case where thermal cracking of a heavy petroleum oil is to be carried by means of a fluidized bed comprising non-porous powder materials of this nature, the surfaces of the particles become covered with polymers having tackiness which are produced as the thermal cracking proceeds. As a consequence, when the amount of carbon or coke deposited on the particles becomes large, the particles agglomerate, and the fluidity becomes inadequate. This phenomenon is commonly called "bogging", and must be absolutely avoided in thermal cracking of heavy petroleum oils by means of a fluidized bed.

As the particle size of the fluidized particles is made coarse, the fluidization will become vigorous if the velocity of the fluidizing fluid is increased, whereby the tendency of bogging to occur is reduced. This is the reason why, in the known processes, only fluidized beds of relatively coarse particles (hereinafter referred to as "fluidized coarse-particle bed(s)") have been used.

However, it is well known that in a fluidized coarse-particle bed of this character, the fluidized state is extremely ununiform because of causes such as the generation of large bubbles and slugging, and not only is the progress of the reaction obstructed, but trouble such as loss of the fluidized particles due to attrition and damage or breakage of th apparatus due to adrasive wear easily occur.

On the other hand, it is also well known that a fluidized bed comprising relatively fine particles (hereinafter referred to as "fluidized fine-particle bed(s)"), in comparison with the above described fluidized coarse-particle bed, exhibits a very uniform fluidized state, and the reaction progresses smoothly, undesirable results such as attrition of the fluidized particles and abrasive wear of the apparatus being greatly reduced. In a fluidized fine-particle bed, however, bogging readily occurs since the fluidization is weak, whereby if the bed is used as it is, thermal cracking of a heavy petroleum oil cannot be accomplished.

A possible measure for solving the above described problems will now be considered. Relative to the problems accompanying fluidized fine-particle beds of this character, we have previously proposed a process, as disclosed in the specification of Japanese Pat. Appln. No. 84543/1979.

The process according to this preceding invention has succeeded in carrying out with good efficiency thermal cracking of heavy petroleum oils by means of a fluidized fine-particle bed by using fine particles of specific grain size and shape and, moreover, adding a process step of oxidative regeneration of the used fine-particles. By the process according to this preceding invention, since the quantity of recirculated fine particles can be remarkably increased, the quantity of coke deposited on the particles of the thermal cracking step is greatly reduced.

A feature of this preceding invention is that cracking of heavy petroleum oils can be carried out even at a medium temperature, that is, in the vicinity of 500° C. However, if thermal cracking of heavy petroleum oils could be accomplished at even lower temperatures, and, furthermore, if the quantity of recirculated fine-powder particles could be reduced, it would be even more advantageous.

SUMMARY OF THE INVENTION

It is an object of this invention to provide a process for thermal cracking of heavy petroleum oils by which the above stated advantage can be attained by using, in the thermal cracking of heavy petroleum oils, fine particles possessing specific particle characteristics in the fluidized fine-particle bed.

According to this invention, briefly summarized, there is provided a process for thermal cracking of heavy petroleum oils which comprises thermally cracking a heavy petroleum oil by causing it to contact a heated fluidized bed of solid particles in the presence of steam thereby to obtain principally light petroleum oils, and which is characterized in that these solid particles are stable at high temperatures and are particles of substantially spherical shape of a pore volume of 0.10 to 1.5 $cm^3/g$, pore surface area of 50 to 1,500 $m^2/g$, and a weightmean diameter of 0.025 to 0.25 mm.

The nature, utility, and further features of this invention will be more clearly apparent from the following detailed description beginning with a consideration of general aspects of the invention and concluding with examples of specific experimental practice.

DETAILED DESCRIPTION OF THE INVENTION

1. General description

Figure 1:
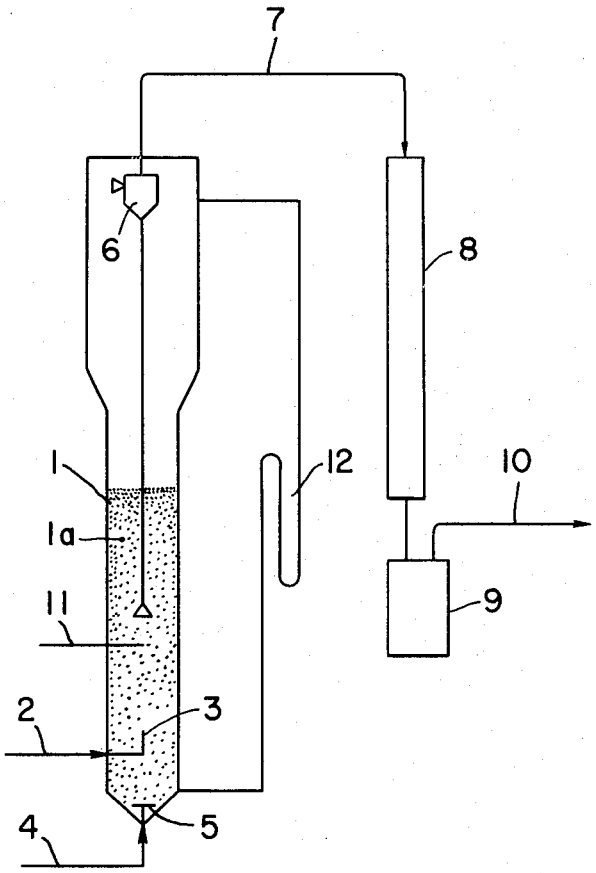
FIG. 1 is a flow sheet indicating one example of the thermal cracking process according to this invention.

According to this invention, as summarized above, the thermal cracking of a heavy petroleum oil by means of a fluidized fine-particle bed is carried out be using porous fine particles in the fluidized bed.

A so-called porous structure has a great number of pores of diameters ordinarily of the order of a number of angstroms to a number of thousands of angstroms formed therein. It is well known that a liquid contacting a porous structure of this nature is instantaneously occluded into pores by capillary pressure arising from surface tension and that, since there is absolutely no wetting of the surface of the particle until the liquid substantially fills the pore volume, in the case where the porous structure is one of a large number of fine or powder particles, these particles, are maintained in a very free-flowing state which is almost the same as their dry state.

The above described characteristic of porous structures was noted in the development of this invention, in which, by using such a fine powdery material as the fluidized particles, thermal cracking is caused to proceed as the heavy petroleum oil is occluded in the pores of the particles. Therefore, since the particle surfaces are not covered by a tacky polymer (the tacky polymer is accommodated in the pores) as in the case of non-porous material, a stable fluid state, which is characteristc of a fluidized fine-particle bed, can be constantly maintained without any occurrence of bogging even when the quantity of deposited coke due to the tacky polymer becomes great. Because a homogeneous fluidized state can be stably obtained in this manner even when the amount of coke deposit is large, there is no particular necessity of recirculating the fine particles at a great rate.

By the practice of this invention, as indicated also in the examples of practice set forth hereinafter, thermal cracking of heavy petroleum oils can be carried out even at low temperatures such as, for example, 450° C. or lower, which could not be expected with the knowledge relating to prior-art fluidized beds. As a result, only small amounts of by-product gases and coke are formed, and higher yields of light petroleum oils are obtained in comparison with known processes.

For example, among the conventional processes for thermal cracking of heavy petroleum oil by means of fluidized beds, the fluid coking process can be considered to be carried out at the lowest temperatures, but even in this process, the operational temperature is ordinarily in the range of 510° to 570° C., and even in contact reforming of light petroleum oils with the use of fluid catalysts, the operational temperature is ordinarily in the range of 480° to 510° C.

Among the processes for coking heavy petroleum oils, the delayed coking process is known. While this process in not a fluidized bed process, it is a process where thermal cracking is carried out at a relatively low temperature of 430° to 490° C. In this delayed coking process, however, the quantity of coke is very great relative to that of the starting-material oil, and, as a result, the yield of the light petroleum oils is low.

In general, the quantity of deposited coke has a relationship to the Conradson carbon residue (hereinafter referred to as CCR) in the feed heavy petroleum oil. In a known process, the quantity of coke formed is approximately 1.2 to 2 times that of the CCR, and the yield of the light petroleum oils decreases by a corresponding quantity. In contrast, by the practice of this invention, the quantity of coke is approximately 1.2 times or less (ordinarily 1.1 times or less) than that of the CCR. Moreover, the quantity of gaseous hydrocarbons formed is also small, and this further gives rise to the high yield of light petroleum oils.

One reason why thermal cracking of a heavy petroleum oil by the process of this invention is possible at much lower temperatures than those required in known processes is that the fluidized bed used is a fluidized fine-particle bed, but a further reason resides in the unique reaction mechanism involved in the process as described below.

As described hereinbefore, it may be considered that a heavy petroleum oil is caused by capillary action to disperse and be occluded within a large number of pores and that it is then subjected in this state to thermal cracking. In other words, the pores in the particles can be considered to be a countless number of extremely small reactor vessels or reactors, and the heavy petroleum oil is subjected in liquid state to thermal cracking in these "microreactors". For this reason, the oil can be retained for an ample residence time at the reaction temperature, and, moreover, since the gases and light fractions formed as the reaction progresses have a very large particle surface area, they are promptly discharged. Because the cracking progresses in this manner, it is reasonable to think that only one portion of the cracking residue is probably transformed into heavier materials. Non-porous particles having almost no pores, of course, cannot be thought to have "microreactors" therewithin, and therefore a reaction mechanism of this nature cannot be supposed to occur in the case of non-porous particles.

While the particles used in this invention are porous particles and have a considerably large specific surface area, they are not used as a catalyst. Accordingly, although heavy metals such as nickel, vanadium, and iron are ordinarily contained in a feed heavy petroleum oil, such heavy metals have almost no deleterious effect on the thermal cracking (taking place within the pores of the porous particles) which is the main reaction in the process of this invention.

In short, in the process of this invention, the heavy petroleum oil is retained for a long time in the fluidized bed within the "microreactors" and is thereby amply subjected to thermal cracking, whereby the thermal cracking progresses even at a low temperature, and high yield of light petroleum oils can be attained with the formation of only small amounts of gases and coke. Other factors such as uniformization of the reaction conditions of the "microreactors" due to the uniform fluid state are probably contributing also to this feature of this invention. In this invention, the excellent effect exhibited with respect to liquid materials by the pores of porous structures such as the solid particles of a fluidized bed will be called the "capacitance effect".

The possibility of thermal cracking of heavy petroleum oil at low temperatures by the process of this invention leads to several benefits and advantages, one of which is an increase in the thermal efficiency due to a reduction in loss of heat discharged from the apparatus. Another is the facility of selecting the materials of the apparatus together with the elimination of the necessity for using special and expensive materials for withstanding high temperatures. The improvement in the thermal efficiency is particularly advantageous when the process of this invention is coupled to a regeneration step in which case combustion or gasification of the deposited coke is facilitated, and, at the same time, practical benefits such as an increase in the quantity of generated heat of the gases formed and an increase in the quantity of by-product steam.

2. Specific details

The thermal cracking process according to this invention is carried out through the use of a fluidized fine-particle bed, which comprises porous fine powder particles possessing a "capacitance effect" as described hereinbefore.

2-1. Fine particles

Particles possessing an ample capacitance effect according to this invention comprise porous structures having suitable pore volume or capacity and surface area. The methods of measuring the pore volume and specific surface area of porous structures have been established, and these values can be determined with considerable accuracy, for example as disclosed in Yoneda, Yukio: "Shokubai Kōgaku Kōza 4" ("Catalyst Engineering Lectures 4"), 1975, published by (K.K.) Chijin Shokan, Japan.

According to this invention, the pore volume of the fine particles used is 0.10 to 1.5 $cm^3/g$, preferably 0.2 to 0.8 $cm^3/g$. It has been found that when the pore volume of the particles is less than 0.10 $cm^3/g$, the capacitance effect is inadequate, whereby bogging, for example, readily occurs during fluidization. On the other hand, when the pore volume exceeds 1.5 $cm^3/g$, the capacitance effect is ample, but the mechanical strength of the particles greatly drops, in general, and the particles are inadequate as fluidized particles.

The surface area of these porous fine particles is 50 to 1,500 $m^2/g$, preferably 100 to 600 $m^2/g$. If the pores of these particles are to function as "microreactors", the size of the pores into which the feed heavy petroleum oil is to be introduced should become a problem. In the case where the diameter of the pores of the particles is of a very small value of 10 angstroms or less, it may be difficult for the heavy petroleum oil to infiltrate into the pores. Even if the heavy petroleum oil should infiltrate into the pores, it can be considered that the pores will be easily clogged by deposited coke or the like. On the other hand, in the case of very large pores such as 5,000 angstroms or more, the attraction of the heavy petroleum oil due to capillary pressure may be considered to be insufficient.

However, accurate measurement of the pore diameter is considerably difficult, and quantitative discussion with respect to the above is also very difficult. In contrast, the specific area of the particles can be measured with relative accuracy. Then, if the value of the specific surface area is 50 to 1,500 $m^2/g$, and, moreover, the pore volume is 0.1 to 1.5 $cm^3/g$, among ordinary porous structures, those of pore diameters of the above mentioned 10 to 5,000 angstroms will become predominant, whereby the specific surface area can be used as an index of the porosity of the particles.

Furthermore, the fine powder particles used in this invention must have a weight-mean diameter of 0.025 to 0.25 mm, preferably 0.04 to 0.12 mm and be substantially spherical in shape. By the practice of this invention, in correspondence with the fact that the fine particles are porous, a fluidized fine particle bed can be stably formed without trouble due to coke deposit. For this reason, the range of the weight-mean diameter of the fine particles used can be widened further than in the case of our previous invention mentioned hereinbefore.

Furthermore, it is preferable that, in these fine particles, the content of those of weight-mean diameters of 0.044 mm or less be of the order of 5 to 50 percent by weight. In this invention, the expression "the solid particles are particles of substantially spherical shape" is intended to mean that, even if each individual particle has some concavities and convexities on its surfaces, the particle as a whole is substantially spherical, and, moreover, such particles constitute approximately 90 percent or more of the entire mass of particles.

The particles to be used in the process of this invention must, in addition to satisfying the above described requirements, be stable at high temperatures. More specifically, the particles which have been used are ordinarily heated to approximately 600° C. or more, preferably to approximately 700° C. or more, in the regeneration step in order to raise their temperature to a value necessary for their function as a heat source in the cracking process and, at the same time, to gasify and remove the deposited coke. Accordingly, these particles must have the characteristic whereby their "capacitance effect" is not substantially reduced when they are heated to such temperatures. Furthermore, since the gasification of the deposited coke in this regeneration process is ordinarily accomplished by causing the coke to contact a gas containing oxygen, it is desirable that these particles be stable also in such an oxidizing atmosphere.

In the case where these particles possess a catalytic function with respect to the cracking and other reactions of heavy petroleum oils, some additional advantages might be enjoyed, but the particles in this invention are not required to possess such catalytic activity.

Specific examples of particles suitable for use in this invention will now be considered. As for materials, there are: silica-alumina and zeolite, each of which is used as a fluid catalyst for contact reforming of, for example, kerosene into gasoline; alumina and silica, each of which is being used, for example, as a carrier of a fluid catalyst; active carbon, which in the form of a fine powder is being used, for example, for uses such as processing of waste water and waste gases, and others.

Good examples of spherical particles are, essentially, the above mentioned fluid catalysts, carriers for fluid catalysts, active carbon in the form of microspheres, etc. These are granulated artificially by a process such as spray drying or fluidized bed granulation. It should be mentioned that, ordinarily, ordinary crushed particles and the like do not satisfy the condition of being substantially spherical according to this invention.

Of these fine particles, alumina-predominant particles and silica-predominant particles are particularly preferable. The reason for this is that their pore volumes, surface areas, etc. vary only very slightly at even approximately 800° C. In the case of microspherical active carbon, its stability at high temperatures is ample, but its stability with respect to oxidizing gases is inadequate. For this reason, it is necessary to reduce loss at the time of regeneration by measures such as lowering of the oxygen concentration in the atmosphere in the regeneration process and the use of steam.

The terms "alumina-predominant" and "silica-predominant" as used herein respectively mean that alumina and silica are contained in quantities of approximately 90 percent by weight or more, preferably approximately 95 percent by weight or more. Accordingly, so-called "silica-alumina", which can be thought to be a eutectic crystal material of alumina and silica is not referred to as: alumina-predominant or silica-predominant as long as the content of silica or alumina is not approximately 90 percent or higher. The fine-powder particles used in this invention may be a mixture, for example, a mixture of alumina-predominant particles and silica-predominant particles.

In short, the particles used for the fluidized bed according to this invention are not limited to those described above provided that their pore volume and specific surface area can be maintained substantially stable under the conditions to which they are subjected in the thermal cracking process of this invention and in the regeneration process.

2-2. Feed oil and products formed

The feed heavy petroleum oil used in this invention is not subject to any particular limitation relating to its characteristics such as its CCR, sulfur content, and heavy metal content. Specific examples of suitable feed heavy petroleum oils are: crude oil containing much heavy fractions; residue oil obtained by distillation at atmospheric pressure from a petroleum refining process (hereinafter referred to simply as atmospheric residue); residue similarly obtained by distillation under reduced pressure (hereinafter referred to as vacuum residue); and recovery oils extracted from oil shale and tar sand. Of these oils, those of relatively high CCR value, for example, approximately 10 or higher, afford a greater effectiveness of the process of this invention in comparison with other processes.

The term "heavy petroleum oil" as used herein means a mixture of hydrocarbons having relatively large amounts of a high boiling point content and CCR and includes those that are solids at room temperature.

The principal products obtained from thermal cracking of these heavy petroleum oils are gasoline of a boiling point at an atmospheric-pressure of 220° C. or lower and kerosene of a boiling point of at an atmospheric-pressure 220° to 510° C. The yield of these principal products can be widely varied depending on principally the temperature conditions of the thermal cracking. Furthermore, as a by-product of the thermal cracking reaction, a high calorie gas of a net calorific value of approximately 5,000 to 10,000 Kcal/Nm$^3$ is obtained.

In the case where the regeneration of the used particles is carried out by heating in contact with an oxygen-containing gas such as air, air and steam, or oxygen and steam, a medium to low calorie gas useable as fuel or for synthesis and/or steam are (is) obtained from the regeneration process. A portion or all of this steam can be consumed for feeding into the thermal cracking process.

2-3. Thermal cracking process

The thermal cracking process of this invention is carried out by causing a heavy petroleum oil to contact a fluidized bed of the aforedescribed fine particles heated in the presence of steam.

2-3-1. Thermal cracking reaction apparatus

The reaction tower or reactor accommodating the fluidized fine-particle bed for the thermal cracking of the heavy oil is ordinarily a vertical cylindrical tower and is so adapted that heated solid particles, ordinarily together with the feed oil and superheated steam, are supplied through the lower part of the tower. The solid particles to be subjected to the particle regeneration process may be taken out of the reaction tower at a point between its middle part and its upper part. However, convenience is afforded by an arrangement wherein the particle outlet is provided at the lowermost part of the reaction tower, lower than the supply inlet for the feed oil, and, moreover, the particles are taken out as they are caused to contact the superheated steam in countercurrent flow, since the oil adhering to the particles is stripped by the steam and returns to the thermal cracking process.

In view of the good fluidized state of the fluidized fine-particle bed in the reaction tower, there is no particular necessity of installing therein internals for the purpose of improving the fluid state of the bed although, of course, such internals will not have any adverse effect. However, since a great amount of the solid particles are entrained by the effluent of the light petroleum oils and combustible gases formed, equipment for intercepting and collecting the entrained solid particles and then returning them to the fluidized bed, such as, for example, a cyclone, a dip-leg or the like, is ordinarily provided, and the gaseous thermal decomposition products are passed through this equipment and thereafter discharged. Such equipment is ordinarily used means for fluidized fine particle beds.

The heat required for the thermal cracking of the heavy petroleum oil is supplied principally by the sensible heat of the solid particles in the fluidized bed, but, if desired, the reactor may be provided with suitable heating equipment.

2-3-2. Practicing the thermal cracking process

Into the thermal cracking reaction tower or reactor of the above described character are fed the feed oil, superheated steam, and heated solid particles such as, for example, particles from the particle regneration process and, if necessary, new make-up solid particles. Ordinarily, a portion of the feed oil comprises recycled oil of the heavy petroleum oil fraction obtained together with light petroleum oils from the top of the reaction tower.

While the feed oil, the solid particles, and the superheated steam can be introduced separately into the reaction tower, it is preferable that the solid particles be carried into the tower by the superheated steam and/or the feed oil vapor. Further, it is preferable to introduce the feed oil together with the superheated steam, and, depending on the case, together with the solid particles.

The quantity of the solid particles recirculated into the reaction tower is 2 to 20 times (weight basis), preferably 4 to 10 times, the quantity of the startingmaterial oil supplied.

When the average temperature of the fluidized fine-particle bed within the reaction tower is taken as the reaction temperature, the reaction temperature is 380° to 600° C., preferably 430° to 550° C. It should be mentioned that the temperature of the fluidized fine-particle bed is very uniform, the temperature differences within the bed ordinarily being 5° to 10° C.

It is not necessary that all of the recirculated particles within the reaction tower be particles from the particle regeneration process. New solid particles can be suitably supplemented as replenishment.

In order to effectively practice this invention, it is necessary to feed into the reaction system steam or a gas containing steam as the principal fluidization gas. Other than these gases, the fluidization gas comprises chiefly gaseous decomposition products of the heavy petroleum oil. In a preferred specific example of this invention, the steam quantity is 1 percent by weight or more, preferably 5 percent by weight or more, of the quantity of the heavy petroleum oil. We have found that if the steam quantity is less than 1 percent by weight, the separation of the products of the thermal cracking from the pores in the particles will be inadequate. Furthermore, together with the thermal cracking of the heavy oil, a polymerization reaction tends to progress, whereby the quantity of the deposited coke increases, and, at the same time, the yield of the light petroleum oils decreases.

2-4. Particle regeneration process

A process for regenerating used particles is not indispensable in this invention. However, in the case where fine particles in which the "capacitance effect" referred to in this invention is not reduced as a result of processing in a regeneration process are used in the thermal cracking process, the thermal cracking process of this invention is ordinarily practiced by additionally providing a regeneration process. The reason for this is that regeneration of the particles affords the carrying out of the thermal cracking process over a long time.

The purposes of regenerating the fine particles used in the thermal cracking are principally to remove coke deposit from within the pores in the particles and to impart the necessary heat quantity as heat carriers. In accordance with these purposes, suitable regeneration means are devised.

A suitable regeneration process for the purpose of removing deposited coke within the pores of the particles comprises heating the used particles in contact with a gas containing oxygen. In this case also, it is preferable that the fine particles to be processed are forming a fluidized bed.

A specific example of an oxidation regeneration process depending on a fluidized bed is that according to our aforementioned previous invention (Japanese Pat. Appln. No. 84543/1979). This regeneration process according to this previous invention is as follows.

2-4-1. Regeneration process apparatus

Used solid particles taken out from the reaction tower or reactor of the thermal cracking process are sent into a particle regenerator of the particle regeneration process and, in a fluid state, there contact a gas containing oxygen. As a result, combustible materials, chiefly deposited coke, adhering to the particles are burned or gasified and thus removed, and the particles are heated by the heat thus generated.

The regenerator is ordinarily a cylinder of long length in its axial direction and has an inlet port for supply of used solid particles sent from the thermal cracking process, and outlet port for regenerated and heated solid particles, an inlet port at the lower part of the tower for supplying thereinto the gas containing oxygen, and a discharge outlet port at the top of the tower for discharging combustion gases formed.

The fluidized bed of the regenerator may be an ordinary fluidized fine-particle bed. However, according to a preferred mode of practice, a fluidized bed assembly comprising a plurality of intercommunicating compartments is used, and, as the solid particles are caused to contact the gas in countercurrent contact from the upper part to the lower part of the bed assembly, combustion and removal of the deposited coke and heating of the particles are carried out.

In the case where the fluidized bed is thus divided into a plurality of intercommunicating compartments in vertical arrangement, this division is effected by substantially horizontal partition walls of permeable nature such that they permit the upflow of the gas and the downflow of the solid particles but restrict the rise of the solid particles. For these partition walls, perforated plates, wire mesh, slitted plates, or the like are used. It is desirable that these divisional compartments of the regenerator be of plural number. Furthermore, it is preferable that the combustion or gasification of the deposited coke be carried out in a compartment above the lowermost compartment.

In a preferred mode of practice of this invention, the number of the compartments is at least three. Of these compartments, the uppermost compartment functions principally as a section for preheating the solid particles and cooling the combustion gases by a direct-contact heat exchange due to contacting of the combustion gases and the used solid particles to be regenerated. The intermediate compartment functions principally as a section for combustion or gasification reaction of the deposited coke. The lowermost stage is a section principally for cooling of solid particles due to heat exchange with high-temperature particles which have been regenerated and for preheating the oxygen-containing gas. Dividing the fluidized bed into six or more compartments results in some improvement in effectiveness which is insufficient to justify the increased complexity of the apparatus.

In the regenerator at the upper part thereof, there is installed a device such as, for example, a cyclone and a dip-leg, for catching the solid particles from the fluidized fine-particle bed which have been entrained by and are accompanying the combustion gases and for returning these particles to the fluidized bed. Ordinarily, the combustion gases are first passed through this device and then discharged. The oxygen-containing gas fed into the particle regenerator is ordinarily air.

2-4-2. Practicing the particle regeneration process

In the case where the particle regenerator has an ordinary fluidized bed, the used solid particles to be regenerated are fed into a suitable position and may be taken out from a separate suitable position of the bed.

In the case of a regenerator divided into a plurality of vertically arranged compartments, the solid particles ordinarily are fed into the uppermost compartment of the regenerator and descend, passing through each compartment, to be discharged out from the lowermost compartment. In this case, as the oxygen-containing gas, air at room temperature is ordinarily supplied through the lower part of the regenerator, whereupon, in the lowermost compartment, the air contacts the regenerated solid particles at high temperature descending from the upper compartment. A heat exchange thus takes place, whereby the air is preheated, while the regenerated solid particles are simultaneously cooled to a temperature suitable for their use in the thermal cracking process. By inserting cooling tubes into the lowermost compartment, the cooling of the regenerated particles is further facilitated. The thus preheated air reaches a higher compartment and is consumed in the combustion or gasification of the deposited coke.

The gases at high temperature formed by the combustion or gasification reaction rise further to an upper compartment and contact used solid particles sent from the thermal cracking process. Consequently, principally by heat exchange, the gases preheat the used solid particles to be regenerated, and, at the same time, the temperature of the gases is lowered.

In addition to air, the oxygen-containing gas may be one enriched with oxygen or one in which steam or some other dilution gas is admixed, depending on the necessity. Furthermore, a portion of the oxygen-containing gas may be fed into a compartment other than the lowermost.

The reaction in the regeneration comprises chiefly a reaction of oxidation of the deposited coke on the used solid particles. However, whether the composition of the formed gases will become that of a substantially complete combustion or whether it will become that of an incomplete combustion is related to and influenced by many factors such as the deposited coke concentration of the used solid particles, the height of the fluidized bed, the combustion temperature, the quantity of the oxygen-containing gas, and the method of feeding in of this gas in the regeneration system.

For example, under the conditions of a large quantity of deposited coke on the particles, a high fluidized bed, and a high reaction temperature, there is a great tendency for the combustion to become incomplete, and the concentrations of carbon monoxide and hydrogen in the combustion gases become high. By the process of this invention, since coke deposits within the pores of the particles, the quantity of the deposited coke on the particles can be made remarkably large. As a result, the concentrations of carbon monoxide and hydrogen can be made remarkably higher than those in a known process. Thus, an advantage is afforded in the case where the gases formed in the regeneration process are used as fuel or as starting-material gases for synthesis.

Furthermore, in the case opposite to that described above, in the case where the oxygen-containing gas is additionally fed above the gasification compartment, or in a like case, the combustion approaches a complete combustion, whereby the carbon monoxide in the gases formed decreases, whereas the carbon dioxide increases. In the case where complete combustion is approached, the quantity of heat generated in the reaction tower is great. For this reason, it is also possible by a measure such as the installation of cooling water tubes within the reaction tower to generate superheated steam by utilizing excess heat and to use this steam for the thermal cracking process.

In general, the combustion or gasification reaction of the coke deposited on the used solid particles proceeds at approximately 600° C. or high temperature. For this reason, it is desirable that the regenerator temperature of the regeneration process also be 600° C. or higher. However, a temperature of 900° C. or higher is not necessary.

2-5. Flow sheets

FIG. 1 is a flow sheet indicating one example of practice of the thermal cracking process according to this invention. The principal item in the apparatus shown in FIG. 1 is a fluidized bed reactor 1 for thermally cracking a heavy petroleum oil. The feed heavy petroleum oil, independently by itself or as a mixture with steam or the like, is fed into a fluidized bed 1*a* in the reactor 1 through a pipe line 2 and injection means 3. Furthermore, steam or a mixture of steam and an inactive gas is fed into the reactor 1 through its bottom via a pipe line 4 and a distributor 5.

The lower part of the reactor 1 is filled with porous solid particles, which are fluidized by the above mentioned steam and gaseous materials such as the products of cracking of the heavy oil.

The upper part of the reactor 1 has an expanded diameter, and, near the top thereof, a cyclone and dip-leg 6 is installed to collect fine particles which have entrained and swept upward from the fluidized bed 1*a*. Normally, the fine particles thus collected are returned to the fluidized bed 1*a*. The products of the thermal cracking are transferred via a pipe line 7 into a cooler 8, where liquid products (light petroleum oils) are separated and are received by a receiver 9. Uncondensed or dry gases (by-product gases) are discharged out of the process system via a pipe line 10.

The temperature of the fluidized bed 1*a* and the pressure loss therein are continually measured by a thermocouple 11 and a water manometer 12, respectively.

Figure 2:
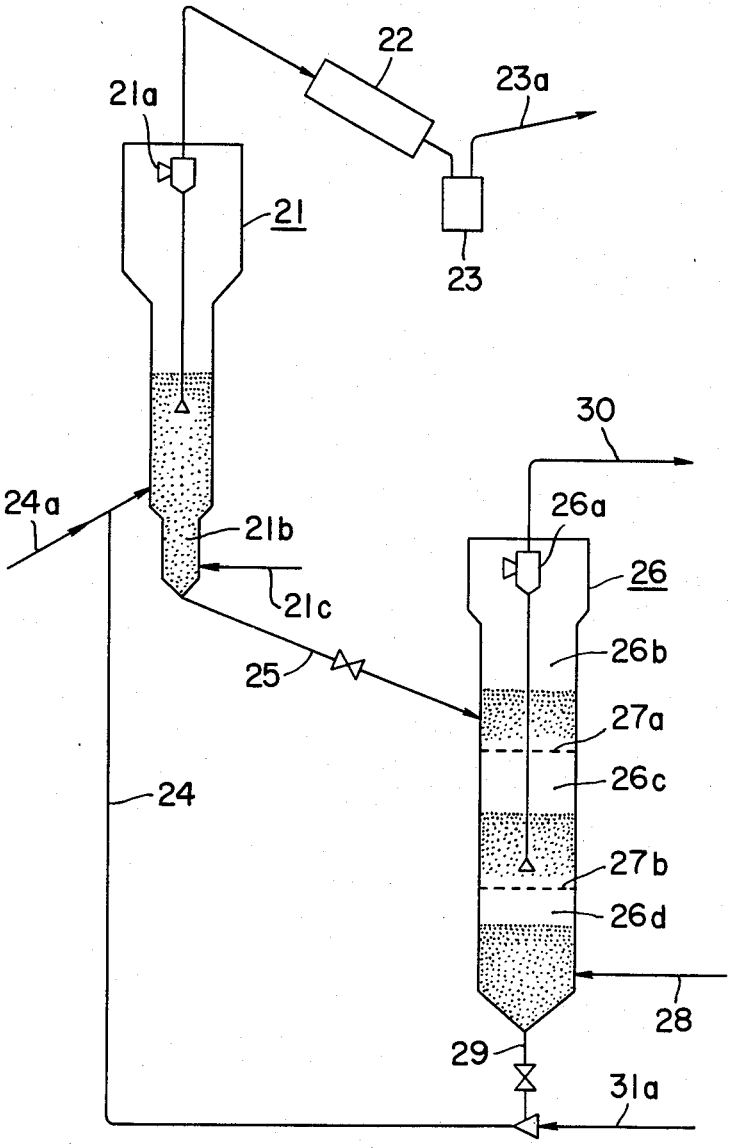
FIG. 2 is a flow sheet indicating a case wherein one example of the thermal cracking process according to this invention is combined with one example of a process for regenerating solid particles which have been used in the thermal cracking process.

FIG. 2 is a flow sheet indicating one example of a mode of practice of this invention in combination with a process for regenerating used solid particles. The fluidized bed reactor 21 is provided therein near the top thereof with a cyclone and dip-leg 21*a* and at the lower end thereof with a stripping zone 21*b*, in which oil adhering to the particles is removed by superheated steam. The light petroleum oils formed by the cracking in the reaction tower 21 are condensed in a condenser 22, and the resulting liquids are collected in a receiver 23. Uncondensed by-product gases are recovered through a pipe line 23*a*.

The feed oil, together with preheated superheated steam, is supplied through a pipe line 24*a* and by way of a recirculation path 24 for particle regeneration to the upper part of the stripping zone 21*b* of the reactor 21. Used solid particles are discharged through the bottom of the stripping zone 21*b* of the reactor 21 and are transferred through a pipe line 25 to the fluidized bed in an upper compartment 26*b* of a regenerator 26.

The regenerator 26 is divided into the above mentioned upper compartment 26*b* having at the upper part thereof a combination of a cyclone and a dip-leg 26*a*, an intermediate compartment 26*c*, and a lower compartment 26*d* having a supply pipe line 28 for supplying air and steam and a particle discharge outlet 29. These compartments 26*b*, 26*c* and 26*d* are intercommunicatively divided by sieve plates 27*a* and 27*b*. Air for combustion or gasification reaction and steam are blown into the fluidized bed of the lower compartment 26*d* through the pipe line 28.

The upper compartment 26*b* of the regenerator 26 constitutes a preheating zone for preheating the used solid particles arriving through the pipe line 25. The intermediate compartment 26*c* constitutes a zone for the main combustion or gasification reaction. The lower compartment 26*d* constitutes a zone for preheating the blown in air and steam and for controlling the temperature of the discharged solid particles. The regenerated particles discharged through the particle discharge outlet 29 are entrained by superheated steam supplied through a pipe line 31*a* and thereby recirculated through the pipe line 24 to the reactor 21 of the thermal cracking process. The gases formed in the regenerator 26 are discharged through an exhaust pipe line 30.

2-6. Experimental examples

In order to indicate more fully the nature and utility of this invention, the following specific examples of experimental practice are set forth, it being understood that these examples are presented as illustrative only and are not intended to limit the scope of the invention.

EXAMPLE 1

(1) An apparatus similar to that illustrated in the accompanying FIG. 1 was used. The inner diameter of the main structure of the fluidized bed reactor at its middle part was 8.1 cm, and the inner diameter of its expanded upper part was 15.8 cm. The effective height of the reactor was approximately 2 meters (m), and all parts thereof was made of stainless steel.

For the fluidized particles, 4 liters of alumina-predominant, microspherical particles for use as fluid catalyst carrier were charged into the reactor.

As steam, preheated to approximately 450° C., was supplied constantly at a rate of 640 grams/hour (g/hr) through the distributor at the bottom of the reactor, Minas atmospheric residue was constantly fed at a rate of 1,280 g/hr into the fluidized bed through the feed oil injector disposed above the steam distributor. At this time, the temperature of the fluidized bed was maintained at 450° C., and the pressure was maintained at atmospheric pressure.

With the elapse of time from the start of feeding of the feed heavy petroleum oil, the pressure loss in the fluidized bed increased, and it was confirmed that deposited coke was steadily accumulating within the fluidized bed. However, it was confirmed from the fluctuations in the pressure loss in the fluidized bed that bed was being maintained in a very good fluidized state until the operation was stopped one hour after the start of the reaction.

The products formed in the thermal cracking were cooled with water and then with dry ice, and the resulting condensed fraction was subjected to an ordinary simple distillation or differential distillation thereby to determine its distillation curve. Furthermore, the quantity of the gas passing through the cooler was measured, and its composition was determined by the gas chromatography method.

In addition, after completion of the thermal cracking reaction, the fluidized particles were taken out of the reactor, and from their weight and composition as determined by elementary analysis, the quantity of the deposited coke was determined.

(2) The fresh particles were observed to be substantially spherical and to have the following characteristics.

Bulk density: 0.78 g/cm$^3$; Pore volume: 0.41 cm$^3$/g;
Surface area: 200 m$^2$/g ; Weight-mean diameter: 0.053 mm.

Furthermore, the feed atmospheric residue had the following characteristics.

CCR: 4.9%; Sulfur: 0.13%

(3) As a result of one hour of thermal cracking, the following quantities were obtained on the basis of the feed heavy petroleum oil.

Quantity of gases formed: 3.0% by weight;
Light petroleum oil yield: 100.3% by volume;
Deposited coke: 4.5% by weight.

In the light petroleum oils, the quantity of the fraction corresponding to gasoline of boiling points of 220° C. or lower was approximately 14% by volume.

EXAMPLE 2

For the fluidized particles, 4 liters of microspherical silica for use as fluid catalyst carrier was charged into the reactor. Other particulars such as the feed heavy petroleum oil and the thermal cracking conditions were the same as in Example 1.

The fluidized particles had the following characteristics.

Bulk density: 0.75 g/cm$^3$; Pore volume: 0.35 cm$^3$/g;
Surface area: 150 m$^2$/g ; Weight-mean diameter: 0.063 mm.

The reaction could be continued for one hour in a good fluidized state, whereupon the following results were obtained.

Quantity of gases formed: 4.1% by weight;
Light petroleum oil yield: 100.2% by volume;
Deposited coke: 4.6% by weight.

Among the light petroleum oils, 15% by volume was a fraction corresponding to gasoline.

EXAMPLE 3(REFERENCE EXAMPLE)

For the fluidized particles, 4 liters of microspherical silica of non-porous character having almost no pores was charged into the reactor. Other particulars such as the feed heavy petroleum oil and the thermal cracking conditions were the same as in Example 1.

Together with the start of the feeding of the heavy petroleum oil, the fluctuation of the pressure loss in the fluidized bed increased, indicating a deterioration in the fluidized state. Approximately 10 minutes thereafter, bogging clearly occurred. After 30 minutes, the operation was stopped, and the interior of the reactor was inspected, whereupon it was found that almost all of the once-fluidized particles had coagulated.

EXAMPLE 4

For the fluidized particles, 4 liters of microspherical alumina, which, although they were for use as a fluid catalyst support, had an especially large pore volume, were placed in the reactor. Furthermore, for the starting-material heavy petroleum oil, Minas vacuum residue was used and constantly fed at a rate of 1,370 g/hr.

The properties of the fluidized particles were as follows.

Bulk density: 0.42 g/cm$^3$; Pore volume: 0.70 cm$^3$/g;
Surface area: 300 m$^2$/g; Weight-mean diameter: 0.060 mm.

Furthermore, the feed vacuum residue had the following characteristics.

CCR: 10.2%; Sulfur: 0.18%.

The reaction was carried out for one hour under a good fluidized state, whereupon the following results were obtained.

Quantity of gases formed: 4.2% by weight;
Light petroleum oil yield: 90.8% by volume;
Deposited coke: 11.3% by weight.

In the light oils, approximately 16 percent by volume was a fraction corresponding to gasoline.

EXAMPLE 5

For the starting-material heavy petroleum oil, Khafji vacuum residue was used and fed at a rate of 1,480 g/hr. The thermal cracking temperature was 480° C. Other particulars were the same as in Experimental Example 4. The feed heavy petroleum oil had the following characteristics.

CCR: 22.4%; Sulfur: 5.3% The reaction was carried out for one hour under a good fluidized state, whereupon the following results were obtained.

Quantity of gases formed: 7.0% by weight;
Light petroleum oil yield: 80.2% by volume;
Deposited coke: 24.0% by weight.

In the light petroleum oils, approximately 34% was a fraction corresponding to gasoline.

EXAMPLE 6

For the fluidized particles, fine microspherical active carbon was used. The other thermal cracking conditions were the same as in Example 1. The properties of the fluidized particles were as follows.

Bulk density: 0.54 g/cm$^3$; Pore volume: 0.62 cm$^3$/g;
Surface area: 1,000 cm$^3$/g; Weight-mean diameter: 0.24 mm.

The reaction was carried out for one hour under good fluidized state. The results thus obtained were as follows.

Quantity of formed gases: 10.7% by weight;
Light petroleum oil yield: 92.8% by volume.

The quantity of the deposited carbon could not be measured in this case.

In the light petroleum oils, the gasoline fraction was approximately 34% by volume.

Analysis of Examples

Examples 1, 4 and 5 illustrate cases in which thermal cracking of atmospheric residue and vacuum residue was carried out with the use of alumina-predominant powder particles suitable for the practice of this invention. When the results thus obtained are compared with those of the fluid coking process, which is a known fluidized bed process, it is found that, whereas the ratio of (deposited coke)/CCR is approximately equal to 1.2 by the fluid coking process, it is 1.10, 1.11 and 1.07 in this invention, which are low, and the light petroleum oil yield is high.

Example 2 illustrates the case where silica-predominant powder particles suitable for this invention are used. The results are similar to those of Experimental Examples 1, 4 and 5.

Experimental Example 3 is a comparison example illustrating the case of non-porous particles outside of the purview of this invention and indicating that, in this case, it is practically impossible to carry out the process.

Although Example 6 is within the scope of this invention, it relates to the case wherein particles of particle size, surface area, and other characteristics which are substantially near their limits are used. Since the particles are carbon-predominant, it is necessary, in the case of their processing in the regeneration process, to carry out the gasification of the deposited coke under mild conditions of low oxidative atmosphere.

It should be mentioned that in Examples 1 through 5, the calorific value of the gas which has passed through the cooler was approximately 8,000 to 10,000 Kcal/Nm$^3$ in each case.

What is claimed is:

1. A process for obtaining principally light petroleum oils comprising thermally cracking a heavy petroleum oil by causing the heavy petroleum oil to contact a fluidized bed of heated solid particles in the presence of steam, wherein the solid particles consist essentially of non-catalytic particles that are stable at the temperature of the thermal cracking, are porous with a pore volume of 0.10 to 1.5 cm$^3$/g, have a specific surface area of 50 to 1500 m$^2$/g, have weight-mean diameters of 0.025 to 0.25 mm, and have substantially spherical shape.

2. The process of claim 1 in which the solid particles are of a material selected from the group consisting of alumina-predominant fine particles and silica-predominant fine particles.

3. The process of claim 2 in which the temperature of the solid particles in fluidized state is in the range of 380° to 600° C.

4. The process of claim 1 wherein the bulk density of the solid particles is between 0.42 and 0.78 g/cm$^3$.

5. The process of claims 1, 2, 3, or 4 which is carried out in conjunction with a particle regeneration process in which used solid particles from the thermal cracking process are caused in fluid state to contact an oxygen-containing gas thereby to gasify combustible materials adhering to the used solid particles and thereby to regenerate and heat the solid particles, which are recirculated for reuse to the thermal cracking process.

6. The process of claim 5 in which the particle regeneration process is carried out by means of a fluidized bed vertically divided into a plurality of compartments in which the particles and the oxygen-containing gas mutually contact principally in counterflow state.

* * * * *